US006326110B1

(12) United States Patent
Datta et al.

(10) Patent No.: US 6,326,110 B1
(45) Date of Patent: Dec. 4, 2001

(54) HUMIDITY AND TEMPERATURE INSENSITIVE ORGANIC CONDUCTOR FOR ELECTROPHOTOGRAPHIC SCREENING PROCESS

(75) Inventors: Pabitra Datta, deceased, late of Cranbury; by Diane Gerofsky legal representative, Mercer County, both of NJ (US); Gregory James Cohee, Newtown, PA (US); Nitin Vithalbhi Desai, Princeton Junction, NJ (US); Steven Anthony Colbert; Kangning Liang, both of Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/379,161

(22) Filed: Aug. 23, 1999

(51) Int. Cl.[7] ..... G03G 13/00

(52) U.S. Cl. ..... 430/23; 430/23; 430/62; 430/131

(58) Field of Search ..... 430/23, 28, 62, 430/131, 133

(56) References Cited

U.S. PATENT DOCUMENTS

| | | | |
|---|---|---|---|
| 3,558,310 | 1/1971 | Mayaud | 96/36.1 |
| 4,917,978 | 4/1990 | Ritt et al. | 430/23 |
| 4,921,767 | 5/1990 | Datta et al. | 430/23 |
| 5,370,952 | 12/1994 | Datta et al. | 430/28 |
| 5,405,722 | 4/1995 | Datta et al. | 430/28 |
| 5,407,765 | 4/1995 | Collins et al. | 430/28 |
| 5,519,217 | 5/1996 | Wilbur, Jr. et al. | 250/326 |
| 5,965,901 * | 10/1999 | Heeks et al. | 257/40 |

FOREIGN PATENT DOCUMENTS

| | | | |
|---|---|---|---|
| 00/05625 * | 2/2000 | (WO) | 430/23 |

* cited by examiner

*Primary Examiner*—Christopher D. Rodee
(74) *Attorney, Agent, or Firm*—Joseph S. Tripoli; Dennis H. Irlbeck; Carlos M. Herrera

(57) ABSTRACT

In accordance with the present invention, a method of electrophotographically manufacturing a luminescent screen assembly on an interior surface of a faceplate panel 17 of a color CRT 10 includes the steps of: coating the surface of the panel with a conductive solution to form a volatilizable organic conductive layer 32, and overcoating the organic conductive layer 32 with a photoconductive solution to form a volatilizable photoconductive layer 34. The conductive solution comprises the organic polymer 3,4-polyethylene dioxythiophene polystyrene sulphonate (PEDT/PSS); a methanol-soluble polymer or co-polymer selected from the group consisting of polyvinylpyrrolidone (PVP), poly (vinyl pyridine-co-vinyl acetate) (PVPy-VAc), polymethacrylic acid (PMAA), poly (hydroxyethylacrylate-co-methacrylic acid) (PHEA-MAA) and poly (hydroxyethyl methacrylate) (PHEMA) to reduce organic residue; and a solvent.

3 Claims, 3 Drawing Sheets

HUMIDITY AND TEMPERATURE INSENSITIVE ORGANIC CONDUCTOR FOR ELECTROPHOTOGRAPHIC SCREENING PROCESS

The invention relates to a method of electrophotographically manufacturing a luminescent screen assembly for a cathode-ray tube (CRT) and, more particularly, to a method in which improved materials are used to provide an organic conductive (OC) layer which acts as an electrode for an overlying organic photoconductive (OPC) layer. The improved organic conductive (OC) layer has superior physical and electrical properties compared to prior organic conductive (OC) layers.

BACKGROUND OF THE INVENTION

U.S. Pat. No. 5,405,722, issued to Datta et al. on Apr. 11, 1995, describes an ionic conductor, Luviquat MS 905, manufactured by BASF Corp., Mt. Olive, N.J., as the copolymer used in formulating an organic conductor (OC) for an electrophotographic screening (EPS) process. The ionic conductor is satisfactory for its intended purpose; however, the conductivity of the material is humidity and temperature sensitive. Thus, the need exists for a conductor that is insensitive to humidity and temperature, and has electrical conductivity at least equal to that of the Liquivat MS 905, which is hereafter designated OC-8.

SUMMARY OF THE INVENTION

In accordance with the present invention, a method of electrophotographically manufacturing a luminescent screen assembly on an interior surface of a faceplate panel of a color CRT includes the steps of coating the surface of the panel with a conductive solution to form a volatilizable organic conductive layer, and overcoating the organic conductive layer with a photoconductive solution to form a volatilizable photoconductive layer. The conductive solution comprises the organic polymer 3,4-polyethylene dioxythiophene polystyrene sulphonate (PEDT/PSS); a polymer or co-polymer to reduce organic residue selected from the group consisting of polyvinylpyrrolidone (PVP), poly (vinyl pyridine-co-vinyl acetate) (PVPy-VAc), polymethacrylic acid (PMAA), poly (hydroxyethylacrylate-co-methacrylic acid) (PHEA-MAA) and poly (2-hydroxyethyl methacrylate) (PHEMA), polyvinylbutyral (PVB); and a suitable solvent.

DETAILED DESCRIPTION OF THE PREFERRED EMBODIMENT

Figure 1:
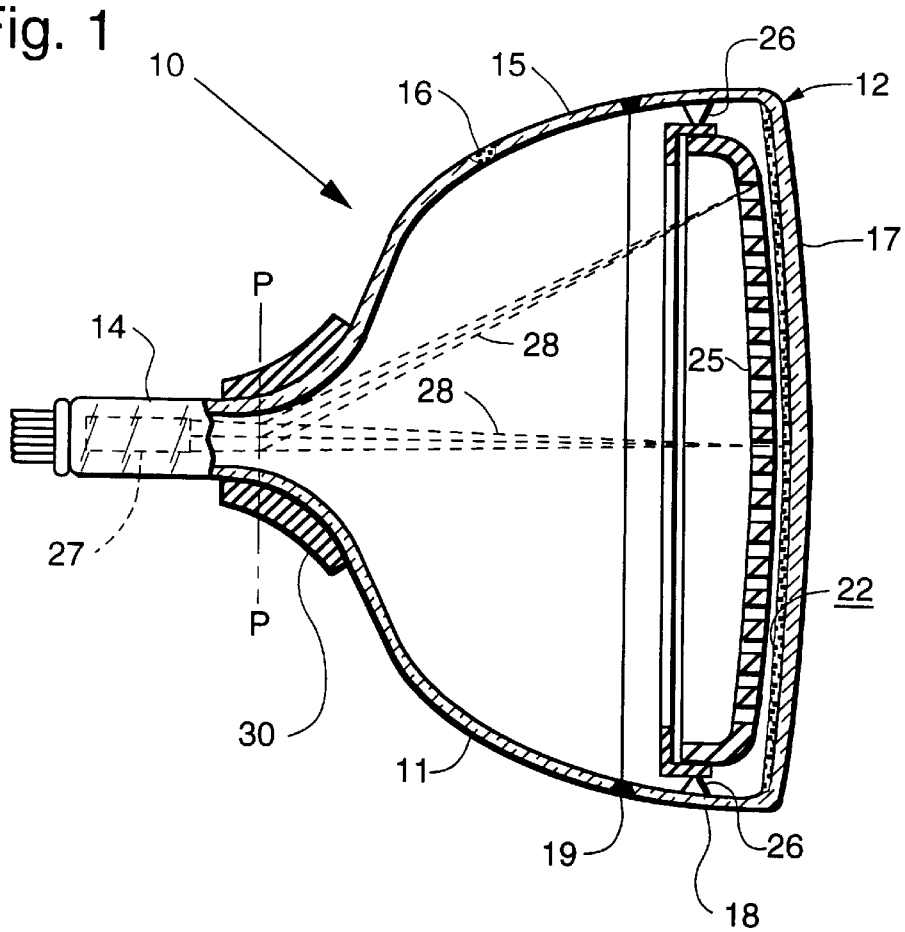
FIG. 1 is a plan view, partially in axial section, of a color CRT made according to the present invention.
Figure 2:
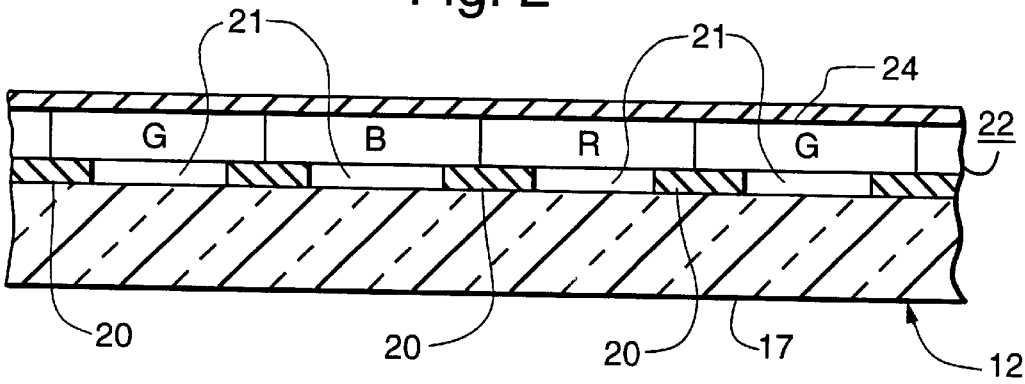
FIG. 2 is a section of a screen assembly of the tube shown in FIG. 1.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate 17 and a peripheral flange or sidewall 18, which is sealed to the funnel 15 by a glass frit 19. As shown in FIG. 2, a relatively thin, light absorbing matrix 20, having a plurality of openings 21, is provided on an interior surface of the viewing faceplate 17. A luminescent three color phosphor screen 22 is carried on the interior surface of the faceplate 17 and overlies the matrix 20. The screen 22, preferably, is a line screen which includes a multiplicity of screen elements comprised of red-, blue-, and green-emitting phosphor stripes, R, B, and G, centered in different ones of the matrix openings and arranged in color groups or picture elements of three stripes or triads, in a cyclic order. The stripes extend in a direction that is generally normal to the plane in which the electron beams are generated. In the normal viewing position of the embodiment, the phosphor stripes extend in the vertical direction. Preferably, portions of the phosphor stripes overlap at least a portion of the light absorptive matrix 20 surrounding the openings 21. Alternatively, a dot screen also may be utilized. A thin conductive layer 24, preferably of aluminum, overlies the screen 22 and provides means for applying a uniform potential to the screen, as well as for reflecting light, emitted from the phosphor elements, through the faceplate 17. The screen 22 and the overlying aluminum layer 24 comprise a screen assembly. Again with reference to FIG. 1, a multi-apertured color selection electrode, such as a shadow mask or focus mask, 25 is removably mounted, by conventional means, in predetermined spaced relation to the screen assembly.

An electron gun 27, shown schematically by the dashed lines in FIG. 1, is centrally mounted within the neck 14, to generate and direct three electron beams 28 along convergent paths, through the apertures in the color selection electrode 25, to the screen 22. The electron gun is conventional and may be any suitable gun known in the art.

The tube 10 is designed to be used with an external magnetic deflection yoke, such as yoke 30, located in the region of the funnel-to-neck junction. When activated, the yoke 30 subjects the three beams 28 to magnetic fields that cause the beams to scan horizontally and vertically, in a rectangular raster, over the screen 22. The initial plane of deflection (at zero deflection) is shown by the line P—P in FIG. 1, at about the middle of the yoke 30. For simplicity, the actual curvatures of the deflection beam paths, in the deflection zone, are not shown.

Figure 3:
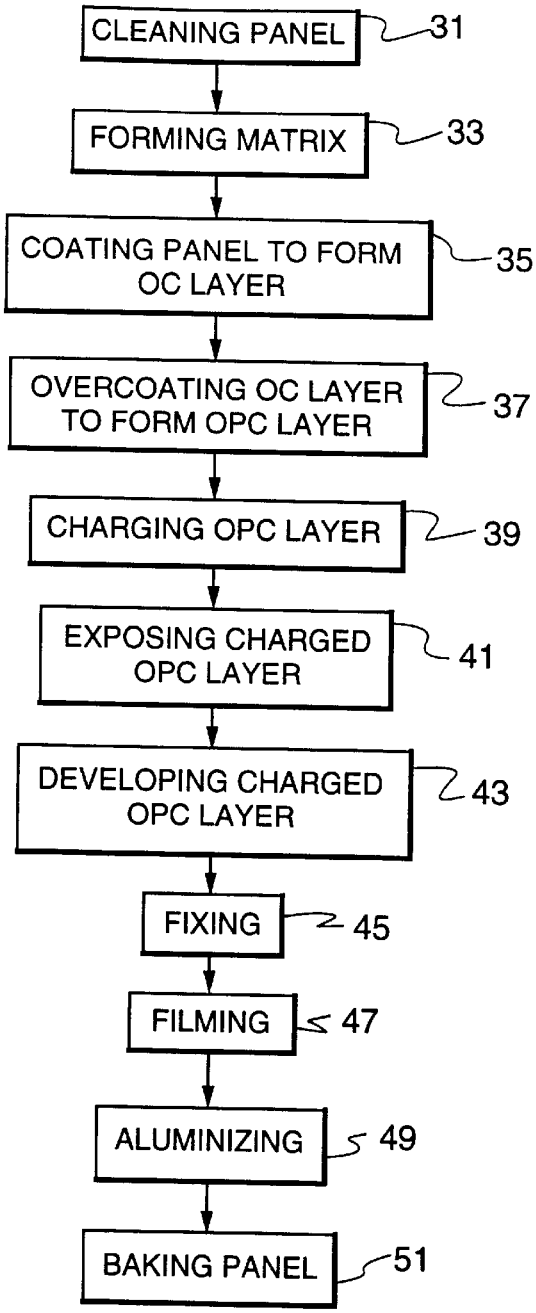
FIG. 3 is a block diagram of the processing sequence utilized in the EPS process.

The screen 22 is manufactured by an electrophotographic screening (EPS) process that is described in U.S. Pat. No. 4,921,767, issued to Datta et al. on May 1, 1990. With reference to step 31 of FIG. 3, the panel 12 is cleaned by washing it with a caustic solution, rinsing it in water, etching it with buffered hydrofluoric acid and rinsing it again with water, as is known in the art. Then, as indicated in step 33, the interior surface of the viewing faceplate 17 is provided with the light absorbing matrix 20, preferably, using the conventional wet matrix process described in U.S. Pat. No. 3,558,310, issued to Mayaud on Jan. 26, 1971. In the wet matrix process, a suitable photoresist solution is applied to the interior surface, e.g., by spin coating, and the solution is dried to form a photoresist layer. Then, the color selection electrode 25 is inserted into the panel 12 and the panel is placed onto a three-in-one lighthouse (not shown) which exposes the photoresist layer to actinic radiation from a light source which projects light through the openings in the color selection electrode. The exposure is repeated two more times with the light source located to simulate the paths of the electron beams from the three electron guns. The light selectively alters the solubility of the exposed areas of the photoresist layer. After the third exposure, the panel is removed from the lighthouse and the color selection electrode is removed from the panel. The photoresist layer is developed, using water, to remove the more soluble areas thereof, thereby exposing the underlying interior surface of the viewing faceplate, and leaving the less soluble, exposed areas of the photoresist layer intact. Then, a suitable solution of light-absorbing material is uniformly provided onto the interior surface of the faceplate panel to cover the exposed portion of the viewing faceplate and the retained, less soluble, areas of the photoresist layer. The layer of light-absorbing material is dried and developed using a suitable solution which will dissolve and remove the retained portion of the photoresist layer and the overlying light-absorbing material, forming the openings 21 in the matrix 20 which is adhered to the interior surface of the viewing faceplate. The interior surface of the viewing faceplate 17, having the matrix 20 thereon, is then coated with a novel conductive solution, as indicated in step 35 to form a layer 32 of a volatilizable, organic conductive (OC) material, shown in FIG. 4. As indicated in FIG. 3, step 37 and shown in FIG. 4, the OC layer 32 provides an electrode for an overlying volatilizable, organic photoconductive (OPC) layer 34. The OC layer 32 and the OPC layer 34, in combination, comprise a photoreceptor 36, also shown in FIG. 4.

The novel OC layer 32 is formed from a conductive solution comprising 3,4-polyethylene dioxythiophene polystyrene sulphonate (PEDT/PSS); a polymer or co-polymer selected from the group consisting of polyvinylpyrrolidone (PVP), poly (vinyl pyridine-co-vinyl acetate) (PVPy-VAc), polymethacrylic acid (PMAA), poly (hydroxyethylacrylate-co-methacrylic acid) (PHEA-MAA), poly (2-hydroxyethyl methacrylate) (PHEMA), polyvinylbutyral (PVB); and a suitable solvent, such as methanol. PEDT/PSS is available from Bayer Corporation, Pittsburgh, Pa., under the tradename BAYTRON P, an emulsion in water (1.4% solid). The procedure for formulating an organic conductive solution, identified as OC-10K, is as follows:

prepare a 10% stock solution of PHEMA in methanol;

prepare an 8:1 dilution of BAYTRON-P as a second stock solution;

add 748 g of 10% PHEMA stock solution to a 1 gallon container;

stir with a high speed mechanical stirrer;

slowly add 1717.5 g of 8:1 BAYTRON-P stock solution to the container;

add 100 g of PVP solution (purchased as a 20% aqueous solution);

add 15 g of 100% L-10 surfactant;

cover container and stir for 1 hour and check for undissolved solids;

replace any methanol lost due to evaporation;

add 855 g of acetone and stir in a covered container for 10 min.;

filter solution using a 10 $\mu$m pre-filter and a 5 $\mu$m final filter; and store the OC-10K solution in a plastic bottle.

The procedure for formulating an organic conductive solution, identified as OC-10-Ft3, is as follows:

prepare a 5% stock solution of PHEMA in methanol;

add 5.93 kg of methanol to a metal container;

add 1.39 kg of 5% the PHEMA stock solution to the container;

add 1.33 Kg of 100% BAYTRON-P add 10 g or tetronic 901 stock solution (25% solids in methanol);

stir the solution of at least 1 hour;

replace evaporated methanol;

filter through both 5 $\mu$m and 10 $\mu$m Millipore filters; and store the OC-10Ft3 solution in a plastic bottle.

The 3,4-polyethylene dioxythiophene polystyrene sulphonate (PEDT/PSS) is diluted with various polymers in order to reduce the organic residue that remains after the resultant OC layer is baked out at 450° C. The polymers or co-polymers that may be used for this purpose include: polyvinylpyrrolidone (PVP); poly (vinyl pyridine-co-vinyl acetate) (PVPy-VAc); polymethacrylic acid (PMAA); poly (hydroxyethylacrylate-co-methacrylic acid) (PHEA-MAA); poly (2-hydroxyethyl methacrylate) (PHEMA); and polyvinylbutyral (PVB). The resistivity of the OC layer 32 with various polymers was determined and is summarized in TABLE 1. The data show that the resistivity of the composition increases by more than one order of magnitude when PEDT/PSS is diluted with different polymers.

TABLE 1

| Identification Number | Coating Composition | Resistivity (MΩ/Sq.) |
|---|---|---|
| OC-10 | 100% PEDT/PSS | 0.4–0.7 |
| OC-10A | 31% PEDT/PSS; 69% PVP | 2–4 |
| OC-10C | 31% PEDT/PSS; 69% PMAA | 1.7 |
| OC-10C-1 | 58% PEDTIPSS; 42% PMAA | 1.0 |
| OC-10C-2 | 13% PEDT/PSS; 87% PMAA | 5.0 |
| OC-10D | 31% PEDT/PSS; 69% VP-VA | 2.8 |
| OC-10D-1 | 58% PEDT/PSS; 42% VP-VA | 1.2 |
| OC-10D-2 | 13% PEDT/PSS; 87% VP-VA | 6.0 |
| OC-10E | 31% PEDTIPSS; 69% HEA-MAA | 5.7 |
| OC-10E-1 | 58% PEDT/PSS; 42% HEA-MAA | 2.5 |
| OC-10E-2 | 13% PEDT/PSS; 87% HEM-MAA | 24.0 |
| OC-10Ft3 | 20% PEDT/PSS; 80% PHEMA | 1.5 |
| OC-10K | 3% PEDT/PSS; 76% PHEMA; 21% PVP | 9.0 |

With respect to OC-10K, the composition includes: 3% PEDT/PSS as the active ingredient; about 76% PHEMA to facilitate bakeout; about 21% PVP as a thickening or viscosity adjusting agent; and about 0.05% Pluronic L-10, or less, available from BASF, Mt. Olive, N.J., as a surfactant. Additionally, acetone may comprise 10–30% of the total mass of the mixture as an anti-foaming agent. The viscosity of the composition is within the range of 15–30 cP and the Pluronic L-10 should be within the range of 0.01 to 1.0% to coalesce the OC film while drying.

Composition OC-10Ft3 includes: 20% PEDT/PSS as the active ingredient; about 80% PHEMA to facilitate bakeout; and about 0.05% Tetronic 901, available from BASF, Mt. Olive, N.J., as a surfactant.

Figure 4:
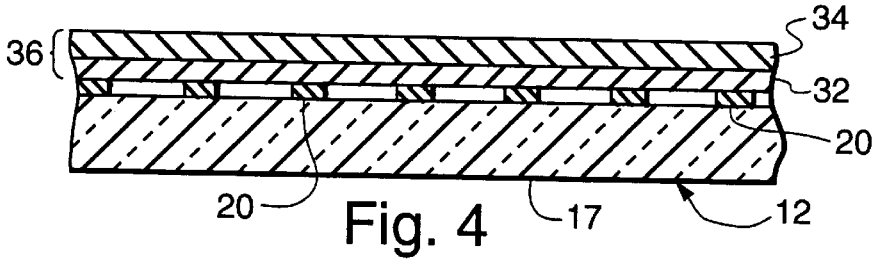
FIG. 4 is a section of a faceplate panel showing an organic photoconductive layer overlying an organic conductive layer.

As indicated in step 39 of FIG. 3 and shown in FIG. 4, the OPC layer 34 of the photoreceptor 36, is corona charged using the charging apparatus described in U.S. Pat. No.

Figure 5:
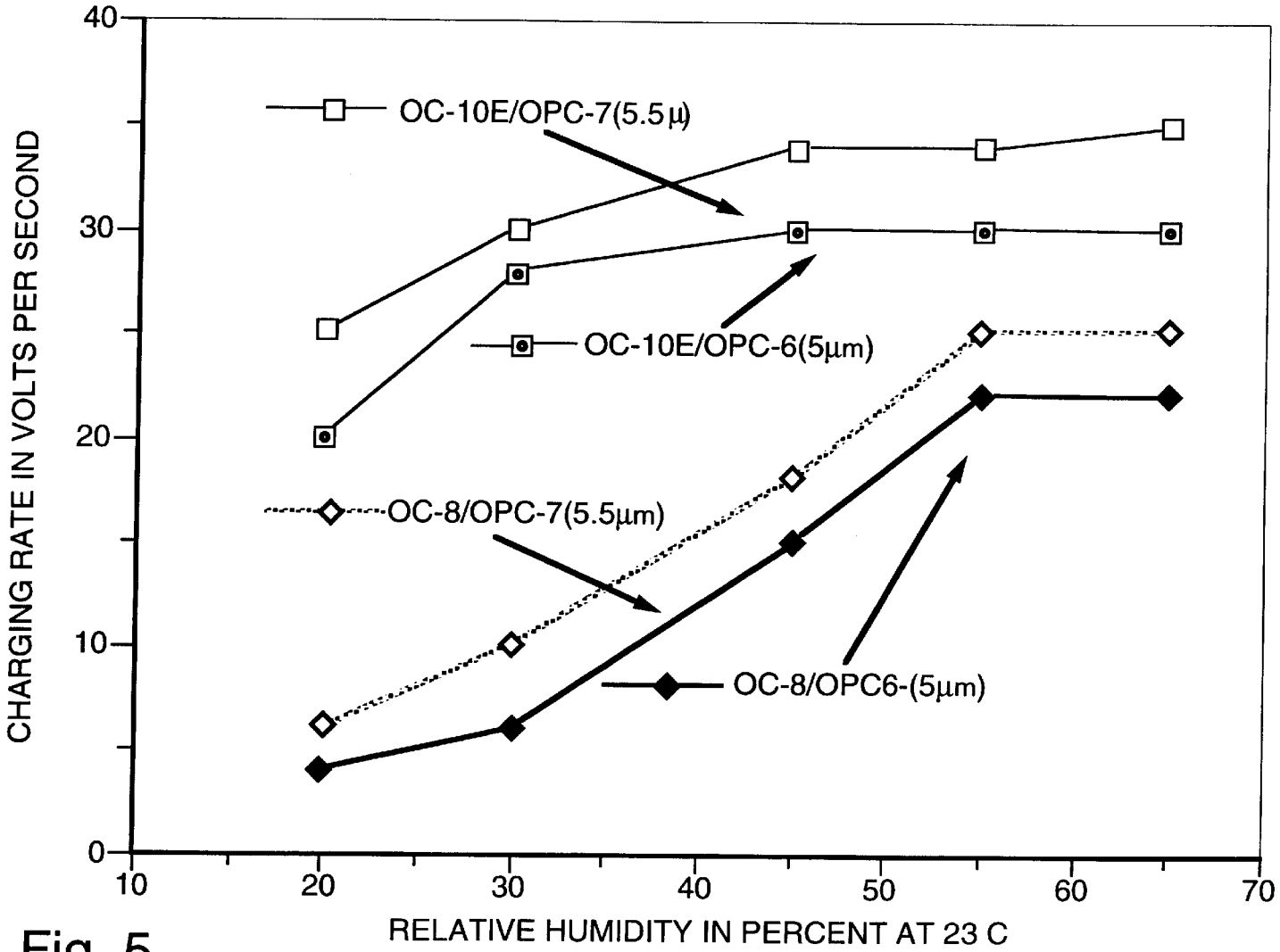
FIG. 5 is a graph of the corona charging rate for several combinations of OPC and OC at different values of relative humidity.

5,519,217, issued on May 21, 1996 to Wilbur, Jr. et al., to establish a substantially uniform charge thereon. FIG. 5 shows a graph of the corona charging rate for several combinations of OC-8 (Luviquat MS-905) overcoated with OPC's 6 and 7 and the present OC-10E (PEDT/PSS), also with OPC's 6 and 7.

The OPC layer 34 is formed by overcoating the OC layer 32 with an organic photoconductive solution comprising a suitable resin, an electron donor material, an electron acceptor material, a surfactant and an organic solvent.

The solution for OPC-6 contains the following ingredients:

2640 g (87.34 wt. %) of xylene; 300 g (9.93 wt. %) of polystyrene, available from Amoco Corp., Chicago, Ill., as Amoco IR7C7;

15 g (0.5 wt. %) of dioctylphthalate (DOP);

50 g (1.65 wt. %) of 1,4-(2,4-dimethylphenyl) 1,4 diphenylbutatriene ((2,4 DMPBT);

15 g (0.5 wt. %) of 2-ethylanthraquinone (EAQ);

2.5 g (0.08 wt. %) of 2,4,7-trinitro-9-fluorenone (TNF); and 0.15 g (trace) of surfactant UL-7602, available from Union Carbide, Danbury, Conn.

OPC-6 may be applied by spin coating; however, if it is desired to electrostatically spray the OPC solution onto the OC layer, a 3:1 xylene-toluene solvent ratio may be used, rather than all xylene. OPC-6 is formulated as follows:

the solvent(s) is added to a 6 quart stainless steel beaker and mechanically stirred and heated to 45° C.;

the polystyrene is added in small quantities until all of the styrene goes into solution; and the stirring is continued until all of the polystyrene is dissolved;

the heat is turned off, and the DOP is added;

the 2,4 (DMPBT) is added while the stirring is continued;

the EAQ is added, while stirring;

the TNF is added, while stirring; and the UL-7602 is added.

Stirring is continued overnight (for at least 12 hours) and then the solution is filtered through a cascade of Millipore filters.

The solution for OPC-7 contains the following ingredients:

2048 g (63.3 wt. %) of toluene and 792 g of xylene;

792 g (24.5 wt. %) of xylene;

300 g (9.3 wt. %) of polystyrene;

75 g (2.3 wt. %) of tetraphenylethylene (TPE);

11.25 g (0.35 wt. %) of EAQ;

7.5 g (0.23 wt. %) of TNF; and 0.15 g (trace) of UL-7602.

The procedure for formulating OPC-7 is similar to that for formulating OPC-6, except that after the surfactant, UL-7602, is added to the solution, the stirring need only be continued for 2–3 hours, until all the materials are dissolved.

The samples shown in FIG. 5 were prepared by coating OC-10E and OC-8 on 3 inch by 3 inch glass slides. The thickness of the OC layers is 1±0.2 $\mu$m. The glass slides with the OC's were coated with OPC-6 and OPC-7. The thickness of the OPC-6 and OPC-7 are respectively 4.5 and 5 $\mu$m. The photoconductivity of OC-10E and OC-8 with the OPC's was determined at different values of relative humidity (RH). The glass slides with OC-10E and different OPC's were stored in a humidity-controlled chamber for one hour before photoconductivity measurements were taken. The OPC/OC samples were corona charged for 25 seconds and the voltage was recorded each second. The corona charging rate was determined from the voltage time plot. The charging rate was calculated for OPC-6 and OPC-7 on OC-10 and compared with charging rates of the same OPC's on OC-8. The results of charging rate measurements taken at various values of relative humidity are plotted in FIG. 5. The results show that corona charging rate of OPC-6 and OPC-7 on the present OC-10E (PEDT/PSS) is twice as fast as the same OPC's on the prior OC-8. The charging rate of the OPC's on OC-10E is less dependent on humidity but the charging rate is lower below 40% RH. These result indicate that OC-10E has better processing latitude than the standard OC-8.

The dark decay and the photo decay of OPC-6 and OPC-7 on OC-8 and OC-10E are summarized in TABLE 2. The OPC/OC combinations, after corona charging for 30 seconds, were kept in the dark for 90 seconds and the voltage on the OPC/OC was recorded every 1 second at relative humidities of 30 and 55 percent (% RH) to determined dark decay. Then, the OPC/OC samples were recharged and, after 90 seconds in the dark, were exposed to 5 xenon light pulses and the voltage on the OPC/OC samples was recorded after each pulse at relative humidities of 30 and 55% RH to determine photo decay.

TABLE 2

| OPC/OC | % RH | Dark Decay (V/sec) | % Photo Decay |
|---|---|---|---|
| OPC-6/OC-10E | 30 | 0.4 | 97 |
| | 55 | 0.9 | 98 |
| OPC-6/OC-8 | 30 | 0.3 | 95 |
| | 55 | 1.0 | 94 |
| OPC-7/OC-10E | 30 | 0.2 | 89 |
| | 55 | 0.8 | 87 |
| OPC-7/OC-8 | 30 | 0.2 | 86 |
| | 55 | 1.0 | 85 |

The thermal decomposition properties of selected ones of the compositions listed in TABLE 1 has been determined using thermogravimetric analysis (TGA). The samples were heated from room temperature to 440° C. at a rate of 1° C./min. and then maintained at 440° C. for 60 minutes. The results are summarized in TABLE 3. The polymer PEDT/PSS, without additives, has about 15% of the organic materials remaining after the bakeout process; however, for OC-10E, the additive HEA-MAA reduces the residue of the PEDT/PSS materials to less than 1%.

TABLE 3

| Identification Number | Coating Composition | % Residue |
|---|---|---|
| OC-10 (Bayer) | 100% PEDT/PSS | 15 |
| OC-10C | 31% PEDT/PSS; 69% PMAA | 4 |
| OC-10D | 31% PEDT/PSS; 69% PVPy-VAc | 6 |
| OC-10E | 31% PEDT/PSS; 69% PHEA-MAA | <1 |
| OC-10Ft3 | 20% PEDT/PSS; 80% PHEMA | 4 |
| OC-10K | 3% PEDT/PSS; 76% PHEMA; 21% PVP | 4 |

The sheet resistivity in ohms/square (Ω/) of the various coating compositions, at different relative humidity (RH) and at a temperature of 20° C. is listed in TABLE 4.

TABLE 4

| ID # | Coating Composition | 21% RH | 34% RH | 55% RH | 65% RH |
|---|---|---|---|---|---|
| OC-8 | MS-905 | 4.7E+09 | 5.0E+07 | 6.4E+07 | 1.3E+07 |
| OC-10 | 100% PEDT/PSS | 1.1E+05 | 1.2E+05 | 7.0E+05 | 4.0E+04 |
| OC-10C | 31% PEDT/PSS; 69% PMAA | 3.3E+05 | 2.0E+05 | 1.7E+05 | 1.5E+05 |
| OC-10D | 31% PEDT/PSS; 69% PVPy-VAc | 1.35E+08 | 1.6E+07 | 2.8E+06 | 3.4E+05 |
| OC-10D1 | 13% PEDT/PSS; 87% PVPy-VAc | 4.7E+09 | 1.8E+08 | 5.0E+07 | 2.6E+07 |
| OC-10D2 | 58% PEDT/PSS; 42% PVPy-VAc | 1.6E+04 | 1.2E+05 | 1.0E+06 | 1.0E+05 |
| OC-10E | 31% PEDT/PSS; 60% PHEA-MAA | 8.8E+07 | 6.8E+07 | 5.7E+07 | 5.4E+07 |
| OC-10E1 | 13% PEDT/PSS; 87% PHEA-MAA | 3.3E+08 | 3.2E+08 | 2.4E+08 | 1.6E+08 |
| OC-10E2 | 58% PEDT/PSS; 42% PHEA-MAA | 5.0E+06 | 3.8E+05 | 2.5E+06 | 2.7E+05 |
| OC-10Ft3 | 20% PEDT/PSS; 80% PHEMA | N/A* | N/A* | 1.5E+06 | N/A* |
| OC-10K | 3% PEDT/PSS; 76% PHEMA; 21% PVP | N/A* | N/A* | 9.0E+06 | N/A* |

*Not available

From TABLE 4 it can be seen that for OC-10, which is pure PEDT/PSS, and for OC-10D2 and OC-10E2 in which the concentration of PEDT/PSS is 58%, there is an irregular interaction with humidity; however, for samples OC-10E and OC-10E1 as the concentration of PEDT/PSS increases the resistivity decreases so slightly that these compositions can be termed humidity insensitive. The single coating concentration of OC-10C that was tested also showed only a slight decrease in resistivity with increasing humidity, however no conclusions can be drawn from one sample. For samples OC-10D and OC-10D1, however, as the concentration of PEDT/PSS increases the resistivity decreases with increasing humidity at a somewhat greater extent than for samples OC-10E and OC-10E1. For samples OC-10Ft3 and OC-10K, only a single concentration was tested at 55% RH and no conclusions can be drawn. Because samples OC-10C, OC10E, and OC-10E1 exhibit little change in resistivity as the humidity increases, it can be concluded that a proper mixture of PEDT/PSS and one of the polymers mentioned in TABLE 4 can produce an organic polymer that is relatively insensitive to changes in humidity. The results of selected coating compositions listed in TABLE 4 versus relative humidity are shown in FIG. 6.

After the OPC layer 34 of the photoreceptor 36 is electrostatically charged to a voltage within the range of approximately +200 to +700 volts, the color selection electrode 25 is then inserted into the panel 12 and placed onto a lighthouse (not shown). The positively charged OPC layer 34 of the photoreceptor 36 is exposed, as indicated in step 41 of FIG. 3, through the color selection electrode 25, to light from a xenon flash lamp, or other light source of sufficient intensity, such as a mercury arc, disposed within the lighthouse. The light which passes through the apertures in the color selection electrode 25, at an angle identical to that of one of the electron beams from the electron gun of the tube, discharges selected illuminated areas of the OPC layer 34 and forms a latent charge image (not shown). The color selection electrode 25 is removed from the panel 12 and the panel is placed onto a first phosphor developer (also not shown). The latent charge on the OPC layer 34 is developed, as indicated by step 43. The charging, exposing and phosphor developing steps, 39, 41 and 43, respectively, are repeated a total of three times to form the three-color phosphor screen 22. The three phosphors are fixed to minimize displacement, as indicated in step 45 of FIG. 3, to the OPC layer 34 of the photoreceptor 36 by contacting the phosphor materials with the vapor of a suitable solvent, in the manner described in U.S. Pat. No. 4,917,978 issued to Ritt et al. on Apr. 17, 1990. The screen structure is then spray-filmed and aluminized, as indicated in steps 47 and 49, respectively, to form the luminescent screen assembly. The screen assembly is baked at a temperature of about 435° C. for about 30–45 minutes, as indicated in step 51, to drive off the volatilizable constituents of the screen assembly.

What is claimed is:

1. In a method of manufacturing a luminescent screen assembly on an interior surface of faceplate panel for a color CRT comprising the steps of coating said surface of said panel with a conductive solution to form a volatilizable organic conductive layer, and overcoating said organic conductive layer with a photoconductive solution to form a volatilizable photoconductive layer, the improvement wherein said conductive solution comprises: 3,4-polyethylene dioxythiophene polystyrene sulphonate (PEDT/PSS); a polymer or co-polymer selected from the group consisting of polyvinylpyrrolidone (PVP), poly (vinyl pyridine-co-vinyl acetate) (PVPy-VAc), polymethacrylic acid (PMAA), poly (hydroxyethylacrylate-co-methacrylic acid) (PHEA-MAA) and poly (2-hydroxyethyl methacrylate) (PHEMA); polyvinylbutyral (PVB) and a suitable solvent.

2. In a method of manufacturing a luminescent screen assembly on an interior surface of a faceplate panel for a color CRT, comprising the steps of:

a) coating said surface of said panel with a conductive solution to form a volatilizable organic conductive layer;

b) overcoating said organic conductive layer with a photoconductive solution to form a volatilizable organic photoconductive layer;

c) establishing a substantially uniform electrostatic charge on said photoconductive layer;

d) exposing selected areas of said photoconductive layer to actinic radiation to affect the charge thereon;

e) developing said photoconductive layer with at least one dry-powdered, light emitting, triboelectrically charged screen structure material;

f) fixing said screen structure material to said photoconductive layer to minimize displacement thereof;

g) filming said fixed screen structure material to form a film layer thereon;

h) aluminizing said filmed layer; and i) baking said faceplate panel in air at a temperature of at least 450° C. to volatilize the constituents of said screen assembly, including said organic conductive layer, said organic photoconductive layer and said film layer, the improvement wherein said conductive solution comprises: 3,4-polyethylene dioxythiophene polystyrene sulphonate (PEDT/PSS); a polymer or co-polymer selected from the group consisting of polyvinylpyrrolidone (PVP), poly (vinyl pyridine-co-vinyl acetate) (PVPy-VAc), polymethacrylic acid (PMAA), poly (hydroxyethylacrylate-co-methacrylic acid) (PHEA-MAA), poly (hydroxyethyl methacrylate) (PHEMA) and polyvinylbutyral (PVB) to reduce residue after said baking step at 450° C.; and a suitable solvent.

3. The method as described in claim 2, wherein said conductive solution further comprise a surfactant, an anti-foaming agent and deionized water.

* * * * *